US008726712B2

(12) United States Patent
Yoo et al.

(10) Patent No.: US 8,726,712 B2
(45) Date of Patent: May 20, 2014

(54) APPARATUS FOR PROCESSING SEALING LIP OF METALLIC CAN, AND METALLIC CAN PROCESSED BY SAID APPARATUS

(75) Inventors: Il Han Yoo, Seoul (KR); Jin Ho Park, Asan-si (KR)

(73) Assignee: Paseco Co., Ltd., Ansan-Si (KR)

( * ) Notice: Subject to any disclaimer, the term of this patent is extended or adjusted under 35 U.S.C. 154(b) by 0 days.

(21) Appl. No.: 13/509,543

(22) PCT Filed: Jan. 11, 2011

(86) PCT No.: PCT/KR2011/000149

§ 371 (c)(1),
(2), (4) Date: May 11, 2012

(87) PCT Pub. No.: WO2011/093601

PCT Pub. Date: Aug. 4, 2011

(65) Prior Publication Data

US 2012/0255962 A1 Oct. 11, 2012

(30) Foreign Application Priority Data

Jan. 28, 2010 (KR) ..... 10-2010-0007881
Sep. 30, 2010 (KR) ..... 10-2010-0095054

(51) Int. Cl.
*B21J 7/16* (2006.01)

(52) U.S. Cl.
USPC ..... 72/402; 72/379.4; 72/391.2; 72/415; 413/23; 413/69

(58) Field of Classification Search
USPC ..... 72/94, 105, 106, 120, 121, 370.16, 72/379.4, 412, 414, 44, 446, 415, 391.2, 72/394, 399, 402; 413/23, 69
See application file for complete search history.

(56) References Cited

U.S. PATENT DOCUMENTS

| | | | | | |
|---|---|---|---|---|---|
| 1,705,843 | A | * | 3/1929 | Walter | 413/38 |
| 1,912,258 | A | * | 5/1933 | Coyle | 72/121 |
| 3,648,884 | A | * | 3/1972 | Mansolino | 220/669 |
| 4,070,888 | A | * | 1/1978 | Gombas | 72/91 |
| 4,176,536 | A | * | 12/1979 | Panknin et al. | 72/91 |
| 4,207,761 | A | * | 6/1980 | Niemi | 72/354.2 |
| 4,308,737 | A | * | 1/1982 | Kannegiesser et al. | 72/91 |
| 4,747,287 | A | * | 5/1988 | Azzaline et al. | 72/125 |
| 8,037,728 | B2 | * | 10/2011 | Hosoi | 72/94 |

FOREIGN PATENT DOCUMENTS

KR 2009076185 A * 7/2009 ..... B21D 51/40

* cited by examiner

*Primary Examiner* — Edward Tolan
(74) *Attorney, Agent, or Firm* — Ballard Spahr LLP

(57) ABSTRACT

The present invention relates to an apparatus for processing a sealing lip of a metallic can, and a metallic can processed by the apparatus. The present invention provides an apparatus for processing a sealing lip of a metallic can comprising: a pressurization block which is lifted and lowered by a lifting means to elastically provide pressure downward; an interlocking means which moves downward step by step by the pressure of the pressurization block and has a coupling relation in which the means stops at stages in the level difference structure of a base so as to be held; and a lip processing member which presses the sealing lip to the inside and outside of a bottle neck of the metallic can while interlocking due to the movement of the interlocking means, and provides a metallic can wherein a notch groove is processed at a beading part by the apparatus for processing a sealing lip of a metallic can.

17 Claims, 10 Drawing Sheets

APPARATUS FOR PROCESSING SEALING LIP OF METALLIC CAN, AND METALLIC CAN PROCESSED BY SAID APPARATUS

CROSS REFERENCE TO RELATED APPLICATIONS

The present application is a National Phase Application of International Application No. PCT/KR2011/000149, filed Jan. 11, 2011, which claims the benefit of Korean Patent Applications No. 10-2010-0007881, filed Jan. 28, 2010 and No. 10-2010-0095054, filed Sep. 30, 2010, which applications are incorporated herein fully by this reference.

FIELD OF THE INVENTION

The present invention relates to an apparatus for processing a sealing lip of a metal can and a metal can processed by the processing apparatus and, more particularly, to an apparatus for processing a sealing lip of a metal can and a metal can processed by the processing apparatus, which can process the sealing lip of the metal can by a press method.

BACKGROUND

In general, a metal can used as a storage container of beverage is mainly made of aluminum or iron.

FIG. 13 shows a metal can formed by a conventional technique and, as shown in FIG. 13, the conventional metal can has a basic body 2 of a bottle with a bottleneck and thus is called a necking can.

The metal can comprises a sealing lip 3 which is formed on the outer surface of the upper end of the bottleneck and connected to a cap to perform sealing, a beading part 4 which is formed at the bottom of the sealing lip 3 to determine whether the cap connected for the sealing is opened and to perform a pilfer-proof function, and a curling part 5 which is formed at the end of the bottleneck for the purpose of finishing.

In detail, the metal can of the type shown in FIG. 13 has the body 2 with the bottleneck by performing a drawing process and a necking process on a plate material. Moreover, the sealing lip 3 is formed by processing a fastening portion in the form of a screw on the outer surface of the upper end of the bottleneck, and the beading part 4 is formed by performing a beading process at the bottom of the sealing lip. Then, the curling part 5 is formed by performing the necking process again on the end of the bottleneck twice and then performing a curling process of bending and winding in the external direction.

Here, the process of forming the sealing lip 3 by processing the fastening portion in the form of a screw on the outer surface of the upper end of the metal can 1 for the connection with the cap is performed in the following manner. The sealing lip 3 is formed by inserting a screw-type inner die into the inside of the entrance of the bottleneck of the can, disposing an outer die close to the outside of the bottleneck of the can, and rotating the inner die and the outer die along the circumference of the can at the same time, followed by forming the beading part 4 at the bottom of the sealing lip 3.

However, according to the above-described conventional technique for processing the sealing lip of the metal can, since the processing of the sealing lip is performed by the rotational motion of the inner die and the outer die, the sealing lip can only be formed into a screw shape as shown in FIG. 13, and thus the can is sealed only with a corresponding screw cap, which imposes significant restrictions on the selection of the cap as well as on the function and design of a metal cap.

Moreover, since the processing of the sealing lip is performed by the rotational motion of the apparatus, the sealing lip is formed into only one shape. Thus, the shape of the sealing lip cannot be diversified, which severely restricts the use of the cap.

Furthermore, while the conventional apparatuses used in other processes in the production of the metal can perform a lifting and lowering motion, the above-described conventional apparatus for processing the sealing lip performs the rotational motion, which should thus be installed separately and require a separate power supply, which is also problematic.

This makes it difficult to provide a continuous process in a single system during the production of the metal can, which has been implicated as a factor that reduces the production efficiency and productivity.

In addition, according to the conventional technique, the process of forming the sealing lip is performed separately, and then the process of forming the beading part should be further performed. Thus, the production process of the metal can is complicated and takes a long time.

Additionally, when the pressure of the metal can produced by the conventional process of forming the sealing lip increases as gas is generated by microbial growth, heat, etc. in the metal can, the center of the cap, which is the most vulnerable part and connected for the sealing, is expanded, and the gas in the can is not discharged to the outside but exploded, which is very problematic.

Technical Problem

Accordingly, the present invention has been made to solve the above-described problems, and an object of the present invention is to provide an apparatus for processing a sealing lip of a metal can and a metal can processed by the apparatus, which can process the sealing lip of the metal can by a press method such that the sealing lip can be formed with various shapes.

Another object of the present invention is to provide an apparatus for processing a sealing lip of a metal can and a metal can processed by the apparatus, which can expand the selection and application of a cap by providing sealing lips of various shapes and allow the apparatus to operate in the same manner as other apparatuses for the production of the metal cal, thereby performing a continuous process instead of a separate process, which requires no additional apparatus and increases the efficiency of the production of the metal can.

Still another object of the present invention is to provide an apparatus for processing a sealing lip of a metal can and a metal can processed by the apparatus, which can form a beading part together with the sealing lip by a press method so as to reduce the equipment and production processes, increase the productivity, and simply and easily form the sealing lip and the beading part of the metal can.

Yet another object of the present invention is to provide an apparatus for processing a sealing lip of a metal can and a metal can processed by the apparatus, which can form a notch groove in a beading part according to an angle of an open surface of divided molds such that a ring-shaped member sealed on the outer surface of the beading part is not easily rotated but caught by the beading part when a sealed cap is rotated to be opened, thereby allowing the cap to be easily opened.

Still yet another object of the present invention is to provide an apparatus for processing a sealing lip of a metal can and a metal can processed by the apparatus, which can form a notch groove in a sealing portion through an open surface of divided molds such that when pressure is created by gas in the can, a small amount of gas can be discharged to the outside through the notch groove to reduce the pressure in the can, thereby preventing explosion of the can.

Technical Solution

To accomplish the above objects of the present invention, there is provided an apparatus for processing a sealing lip of a metal can, the apparatus comprising: a pressurization block which applies pressure downward; an interlocking means which moves downward by the pressure of the pressurization block; and a lip processing member which presses the sealing lip of the metal can from the inside and outside of the metal can while moving in the radial direction of the metal can by the lifting and lowering motion of the interlocking means.

The pressurization block comprises: an internal fastening portion which includes a fastening hole formed in the center thereof and second through holes, formed in the circumferential direction of the fastening hole, to which fastening members are fastened; an external fastening portion which extends in the outward direction and includes first through holes, to which the fastening members are fastened; and a projection which is located at a lower surface between the internal fastening portion and the external fastening portion.

The interlocking means comprises first to third moving bodies which are connected to and disconnected from each other and elastically lifted up and lowered down by the pressurization block.

The first moving body comprises: an upper receiving body which is put on the projection of the pressurization block and includes fastening grooves, to which the fastening members inserted into the first through holes of the pressurization block are fastened; and a lower receiving body which is connected to the upper receiving body and includes an inclined surface which is tapered toward the center at lower end of an inner surface thereof.

The upper and lower receiving bodies are connected to each other in a manner that screw threads formed at lower end of the upper receiving body and upper end of the lower receiving body are engaged with each other.

The second moving body comprises: a first mold which is received in the inside of the projection of the pressurization block; a second mold which is located at the bottom of the first mold and includes a stepped groove formed on the upper and lower surfaces; a third mold which is received in the stepped groove formed on the lower surface of the second mold; and a fourth mold which is located at the bottom of the second mold to surround the outer circumferential surface of the third mold and includes first and second locking projections which project inward and outward from the lower end.

The first mold comprises a hollow hole in the center thereof, fastening through holes which are formed in the circumferential direction of the hollow hole and fastened to the second mold through the fastening members, and fastening grooves which coincide with the second through holes of the pressurization block.

The second mold comprises a hollow hole in the center thereof, first fastening through holes which are formed in the circumferential direction of the hollow hole and fastened to the third mold through the fastening members, second fastening grooves which are formed in the circumferential direction of the hollow hole and fastened to the fourth mold through the fastening members, and fastening grooves to which the fastening members of the first mold are fastened.

The third mold comprises a hollow hole in the center thereof, fastening grooves, formed in the circumferential direction of the fastening hole, to which the fastening members, inserted into the first fastening through holes of the second mold, are fastened, and connecting piece fixing grooves, which are formed in the circumferential direction of the lower surface thereof, to which connecting pieces are inserted and fixed.

A chamber which shares a predetermined region is provided on the boundary of the fastening region between the pressurization block and the interlocking means corresponding to the internal and external fastening portions of the pressurization block, and an elastic member is mounted on the chamber.

The first and second through holes are slide guide holes through which the fastening members freely move.

The fourth mold comprises fastening grooves, to which the fastening members, inserted into the second fastening through holes of the second mold, are fastened, and pin fixing holes which are arranged at regular intervals between adjacent fastening grooves.

The third moving body comprises a connecting portion which is connected to the pressurization block and a bar-shaped moving shaft which penetrates the pressurization block and the interlocking means, is disposed vertically, and includes a projection projecting outward from the lower end.

The lip processing member comprises an inner lip processing mold which includes a plurality of divided bodies which surround the moving shaft, each of the divided bodies including a locking portion on the upper end, which is locked by a first locking projection of the fourth mold, and a male lip processing portion and a male beading processing portion, which are formed on the outer circumferential surface.

The inner lip processing mold further comprises a groove which includes a moving inclined surface being in close contact with the projection of the moving shaft.

The lip processing member comprises first and second outer lip processing molds, which each includes a locking portion on the upper end, which is locked by the first locking projection of the fourth mold, a female lip processing portion and a female beading processing portion, which are formed on the inner circumferential surface and correspond to the male lip processing portion and the male beading processing portion of the inner lip processing mold, and an inclined portion which is placed on the inclined surface of the lower receiving body and formed on the lower end of the outer circumferential surface.

The locking portion comprises pin guide holes which coincide with the pin fixing holes of the fourth mold and each has a diameter greater than that of the pin fixing hole.

The first and second outer lip processing molds are separated from each other and connected by the fastening members.

The divided bodies of the inner lip processing mold comprise a notch portion such that notch grooves are formed on the outer surface of a beading part of the metal can in the inward direction of the boundary of the beading processing portion, and the divided bodies of the second outer lip processing mold comprise a corresponding notch portion corresponding to the notch portion in the outward direction of the boundary of the beading processing portion.

A ring-shaped elastic member is provided on the outer circumferential surface of the inner lip processing mold and at the top of the outer circumferential surface of the first outer lip processing mold.

The elastic member is an extension spring.

To accomplish the above objects of the present invention, there is provided a metal can comprising a notch groove having a predetermined angle in the inward direction and formed at least one of the outer surface of a beading part and a sealing lip processed by the apparatus for processing the sealing lip of the metal can of claim 19.

The interval between the notch grooves of the beading part is 0.8 to 1.2 mm.

The interval between the notch grooves of the sealing lip part is 0.02 to 0.1 mm.

Advantageous Effects

As described above, according to the apparatus for processing the sealing lip of the metal can in accordance with the present invention, the sealing lip of the metal can is processed by a press method, and thus the molding structure in the apparatus can be changed and modified in various ways so as to form the sealing lip, which is to be processed on the outer surface of the metal can, into various shapes, thus significantly expanding the selection and application of a cap corresponding to the sealing lip of the metal can.

Moreover, the present invention can form the beading part together with the processing of the sealing lip by employing the press method, and thus it is possible to reduce the equipment and production processes, increase the productivity, and simply and easily form the sealing lip and the beading part of the metal can.

Furthermore, the apparatus of the present invention can operate in the same manner as other apparatuses which are operated by the lifting and lowering motion for the production of the metal cal, and thus the apparatus can perform a continuous process instead of a separate process, which requires no additional apparatus and increases the productivity of the metal can.

In addition, a notch groove is formed in a beading part according to an angle of an open surface of divided molds such that a ring-shaped member sealed on the outer surface of the beading part is not easily rotated but caught by the beading part when a sealed cap is rotated to be opened, thereby allowing the cap to be easily opened, which improves the convenience of use.

Additionally, a notch groove is formed in a sealing portion through an open surface of divided molds such that when pressure is created by gas in the can, a small amount of gas can be discharged to the outside through the notch groove to reduce the pressure in the can, thereby preventing explosion of the can.

DETAILED DESCRIPTION

Hereinafter, the configuration of the present invention will be described in detail with reference to the accompanying drawings.

Figure 1:
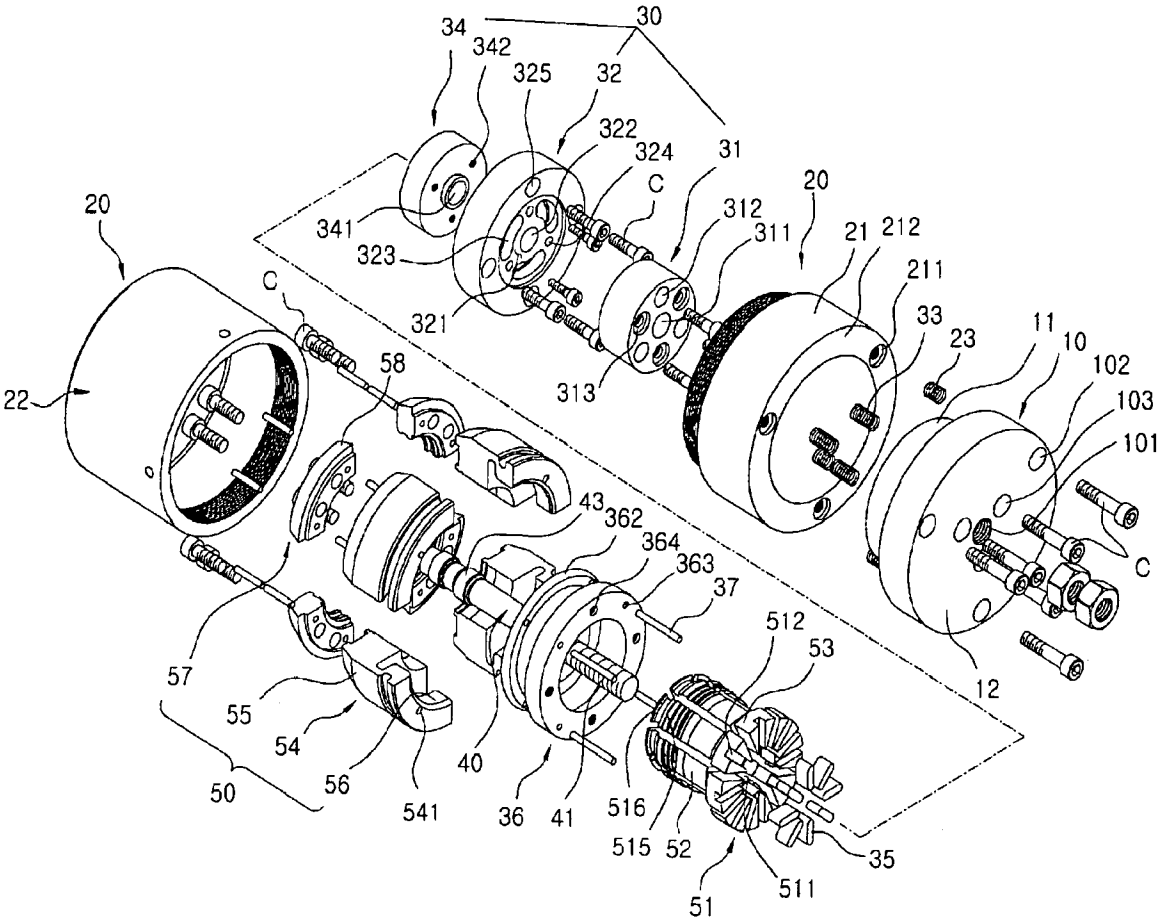
FIGS. 1 and 2 are exploded perspective views showing an apparatus for processing a sealing lip of a metal can in accordance with the present invention.
Figure 2:
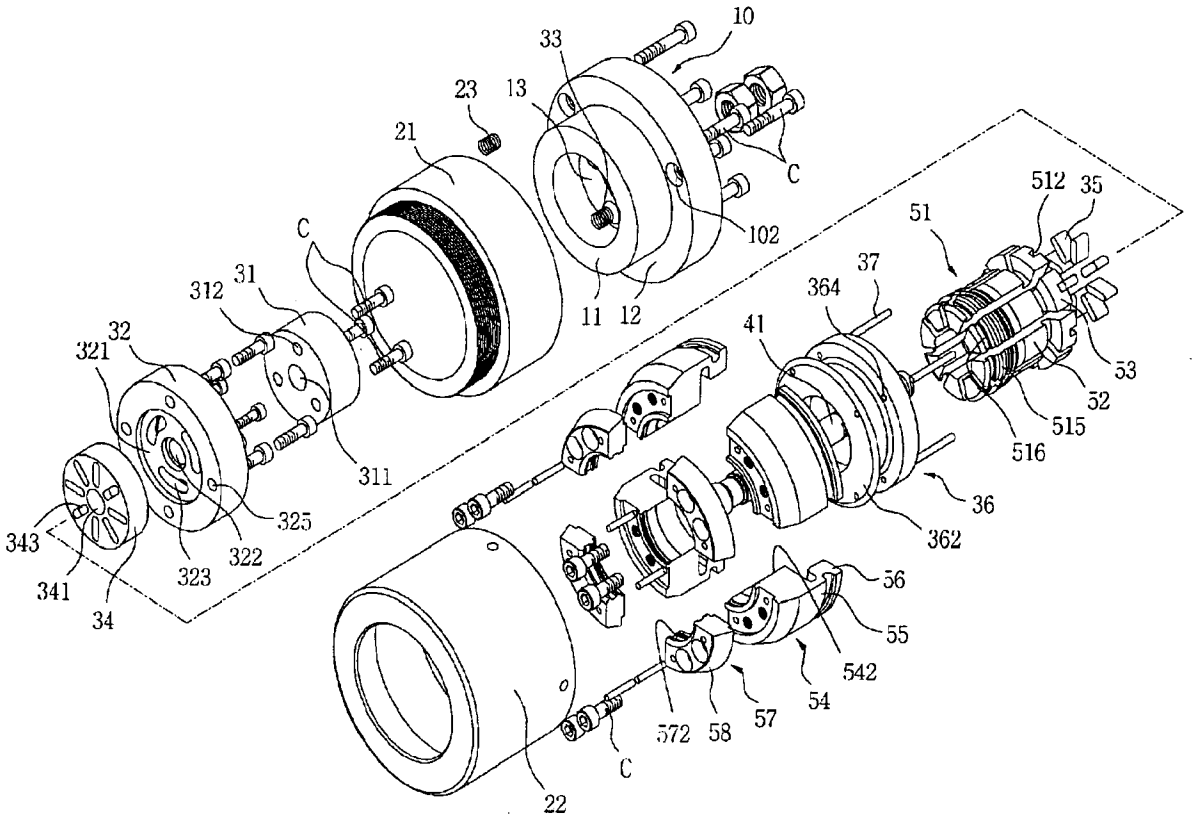

FIGS. 1 and 2 are exploded perspective views showing an apparatus for processing a sealing lip of a metal can in accordance with the present invention.

Figure 13:
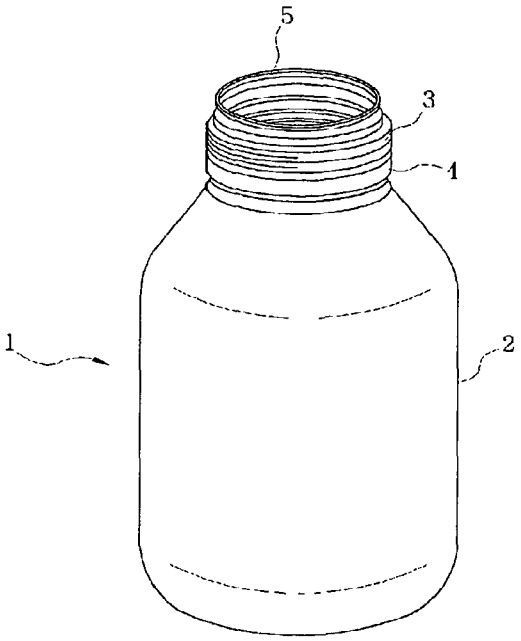
FIG. 13 is a perspective view showing a metal can with a sealing lip produced by a conventional method.

The apparatus for processing a sealing lip of a metal can in accordance with the present invention is lifted up and lowered down by a lifting means (not shown), such as a lifting cylinder, to process a sealing lip on a bottleneck of a metal can 1 (see FIG. 13).

The apparatus for processing the sealing lip of the metal can comprises a pressurization block 10 which applies pressure downward, first to third moving bodies 20, 30, and 40 as an interlocking means which are moved downward by the pressure of the pressurization block 10 and caught sequentially by stepped structures (not shown) of a base (not shown), which is provided in a typical processing equipment and located at the bottom of the apparatus for processing the sealing lip, thus forming a connection relationship, and a lip processing member 50 which is moved in the radial direction of the metal can 1 by the lifting and lowering motion of the first to third moving bodies 20, 30, and 40 to form the sealing lip on the bottleneck of the metal can 1 by performing a press process on the inside and outside of the bottleneck.

The pressurization block 10 comprises a fastening hole 101 in the center thereof, a ring-shaped projection 11 at the bottom thereof which surrounds a first mold 31 of a second moving body 30, which will be described later, an external fastening portion 12 which extends outwardly and includes a plurality of first through holes 102 fastened to an upper receiving body 21, which will be described later, through fastening members C, and an internal fastening portion 13 which includes a plurality of second through holes 103 fastened to the first mold 31 through the fastening members C between the fastening hole 101 and the projection 11. Here, each of the first through holes 102 and the second through holes 103 may preferably be a slide guide hole through which each fastening member C can freely move.

The first moving body 20 is put on the outside of the projection 11 formed on the pressurization block 10 and comprises the upper receiving body 21 having a plurality of fastening grooves 211 fastened by the fastening members C to coincide with the first through holes 102 of the pressurization block 10.

The upper receiving body 21 has a cylindrical structure, in which the inner circumferential surface thereof surrounds the outer circumferential surface of the projection 11 formed on the pressurization block 10, and comprises a fastening protrusion 212 having a screw thread formed on the outside of the lower end, thus being fastened to a lower receiving body 22, which is described later. Here, a chamber A which shares a predetermined region is provided on the boundary between the first through hole 102, into which the fastening member C is inserted, and the fastening groove 211 of the upper receiving body 21, and an elastic member 23 such as a compression spring is mounted on the chamber A.

Moreover, the fastening member C inserted into the elastic member 23 is fastened only to the fastening groove 211 of the upper receiving body 21 and movably inserted into the first through hole 102 of the pressurization block 10 such that the pressurization block 10 can be lifted up and lowered down by the elastic force of the elastic member 23. The lower receiving body 22 comprises a screw thread, which is engaged with the screw thread of the upper receiving body 21 and formed in an inner surface of the upper end, and thus is connected to the upper receiving body 21.

Furthermore, the lower receiving body 22 comprises an inclined surface 221 having a tapered shape, in which an inner surface of the lower end is tapered toward the center.

When the lifting means reaches the lowest point, the lower end of the first moving body 20, i.e., the lower end of the lower receiving body 22 is first caught by a stepped structure (not shown) located on a base (not shown), and thus the first moving body 20 comprising the upper and lower receiving bodies 21 and 22 is no longer lowered.

The second moving body 30 comprises the first mold 31 received in the inside of the projection 11 formed on the pressurization block 10.

The first mold 31 has a circular block structure comprising a hollow hole 311 in the center thereof, a plurality of fastening through holes 312 which are formed in the circumferential direction of the hollow hole 311 and fastened to a second mold 32, which will be described later, through the fastening members C, and a plurality of fastening grooves 313 to which the fastening members C, inserted into the second through holes 103 formed in the internal fastening portion 13 of the pressurization block 10, are fastened. Here, a chamber A which shares a predetermined region is provided on the boundary between the second through hole 103, into which the fastening member C is inserted, and the fastening groove 313 of the first mold 31, and an elastic member 33 such as a compression spring is mounted on the chamber A.

Moreover, the fastening member C inserted into the elastic member 33 is fastened only to the fastening groove 313 of the first mold 31 and movably inserted into the second through hole 103 of the pressurization block 10 such that the pressurization block 10 can be lifted up and lowered down by the elastic force of the elastic member 33.

The second moving body 30 comprises a circular disk-shaped second mold 32 which is located at the bottom of the first mold 31, fixed together with the first mold 31 by the fastening members C, and includes a stepped groove 321 formed on the upper and lower surfaces.

The second mold 32 comprises a hollow hole 322 in the center thereof, a plurality of first fastening through holes 323 which are formed in the circumferential direction of the hollow hole 322 and fastened to a third mold 34, which will be described later, through the fastening members C, and a plurality of fastening grooves 324 to which the fastening members C, inserted into the fastening through holes 312 of the first mold 31, are fastened.

Moreover, the second mold 32 has a circular block structure comprising a plurality of second fastening through holes 325 on the edge which are fastened to a fourth mold 36, which will be described later.

The second moving body 30 comprises the third mold 34 which is located at the bottom of the second mold 32, received in the stepped groove 321, and fixed together with the second mold 32 by the fastening members C.

The third mold 34 comprise a hollow hole 341 in the center thereof and a plurality of fastening grooves 342 to which the fastening members C, inserted into the first fastening through holes 323 of the second mold 32, are fastened.

Moreover, the third mold 34 has a circular block structure comprising a plurality of connecting piece fixing grooves 343, which are formed in the circumferential direction of the lower surface thereof, to which a plurality of connecting pieces 35 are inserted and fixed.

The second moving body 30 comprises the fourth mold 36 which is located at the bottom of the second mold 32 and on the outside of the third mold 34 to surround the outer circumferential surface of the third mold 34 and includes first and second locking projections 361 and 362 projecting inward and outward from the lower end.

The fourth mold 36 comprises a plurality of fastening grooves 363, to which the fastening members C, inserted into the second fastening through holes 325 of the second mold 32, are fastened, and a plurality of pin fixing holes 364 arranged at regular intervals between adjacent fastening grooves 363.

Therefore, the fourth mold 36 is fixed together with the second mold 32 by the fastening members C and, at the same time, fixed together with a first outer lip processing mold 54 of the lip processing member 50, which will be described later, by fixing pins 37.

When the lifting means reaches the lowest point, the lower end of the second moving body 30, i.e., the lower end of a second outer lip processing mold 57, which will be described later, is second caught by the stepped structure located on the base (not shown), and thus the second moving body 30 which has the above-described block shape and is fixed by the fastening members C, is no longer lowered.

The third moving body 40 comprises a connecting portion 42 which is engaged with the screw thread of the fastening hole 101 of the pressurizing block 10 and a bar-shaped moving shaft 41 which penetrates the second moving body 30 and a hollow hole 511 of an inner lip processing mold 51, which will be described later, is disposed vertically, and includes at least one projection 43 projecting outward from the lower end. Here, while there are two projections 43 in a preferred embodiment of the present invention, the invention is not limited thereto, but the number of projections 43 may be reduced or increased, if necessary.

The moving shaft 41 is an operating means which operates until the pressurizing block 10 reaches the lowest point and operates to open the inner lip processing mold 51, which will be described later, in the outer circumferential direction. That is, the projections 43 of the moving shaft 41 move along a moving inclined surface 514 of a groove 513 of the inner lip processing mold 51 to move the inner lip processing mold 51 outward by the projected interval.

The lip processing member 50 comprises the inner lip processing mold 51 composed of a plurality of divided bodies 52 which surround the moving shaft 41.

The inner lip processing mold 51 comprises a hollow hole 511 in the center thereof, which is opened and closed, a locking portion 53 on the upper end, which is locked by the first locking projection 361, and a plurality of connecting piece inserting groove 512 at regular intervals through which the connecting pieces 35, inserted into the connecting piece fixing grooves 343 of the third mold 34, are inserted to prevent rotation and separation of the divided bodies 52.

Moreover, the inner lip processing mold 51 comprises the groove 513 formed inside the hollow hole 511 and having the moving inclined surface 514, which is in close contact with the projections 43 of the moving shaft 41, and a male lip processing portion 515 formed on the outer circumferential surface of the divided bodies 52 to provide a sealing lip structure.

Furthermore, on the outer circumferential surface of the inner lip processing mold 51, a male beading processing portion 516 for formation of a beading part 4 of the metal can is provided at the bottom of the male lip processing portion 515.

The lip processing member 50 comprises the first and second outer lip processing molds 54 and 57 which are composed of the plurality of the divided bodies 52 which surround the fourth mold 36 and the inner lip processing mold 51.

The first outer lip processing mold 54 comprises a locking portion 56 on the upper end, which is locked by the second locking projection 362 of the fourth mold 36.

Moreover, the locking portion 56 comprises a plurality of pin guide holes 541 which coincide with the pin fixing holes 364 of the fourth mold 36 and each has a diameter greater than that of the pin fixing hole 364 such that the divided bodies 55 of the first outer lip processing mold 54 are not rotated and separated while maintaining the moving interval limited to the left and right.

The second outer lip processing mold 57 is firmly fixed by the first outer lip processing mold 54 and the fastening members C. Here, an inclined portion 59, which is placed on the inclined surface 221 of the lower receiving body 22, is formed on the lower end of the outer circumferential surface of the first outer lip processing mold 54 and the entire outer circumferential surface of the second outer lip processing mold 57, and a female lip processing portion 542, which corresponds to the male lip processing portion 515 of the inner lip processing mold 51, is formed on the lower end of the inner circumferential surface of the first outer lip processing mold 54 and the entire inner circumferential surface of the second outer lip processing mold 57.

In particular, a female beading processing portion 571, which corresponds to the male beading processing portion 516, is formed on the inner circumferential surface of the second outer lip processing mold 57.

Here, the molding structure of the male lip processing portion 515 and the corresponding female lip processing portion 542 may be changed and modified in various ways, and thus it is possible to form the sealing lip, which is to be processed on the outer surface of the metal can 1, into various shapes. Moreover, the inner lip processing mold 51 and the first outer lip processing mold 54 may be replaced with other ones having a shape of a sealing lip to be processed.

Figure 3:
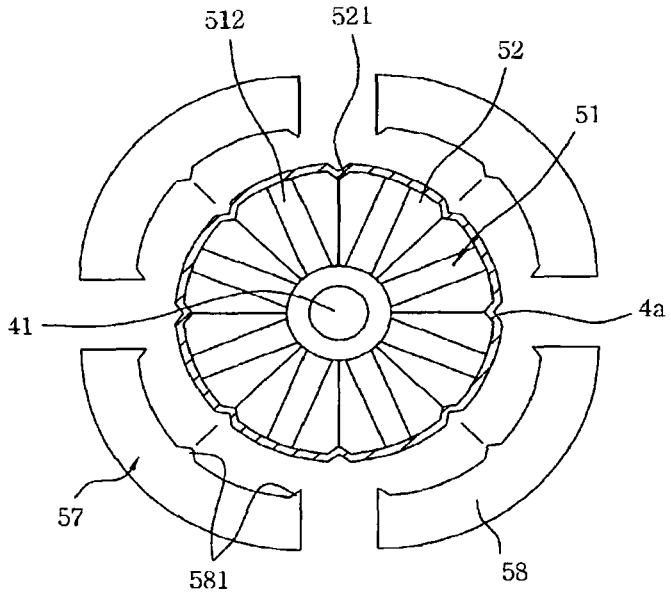
FIG. 3 is a plan view showing a notch portion and a corresponding notch portion provided in the apparatus for processing the sealing lip of the metal can in accordance with the present invention.
Figure 4:
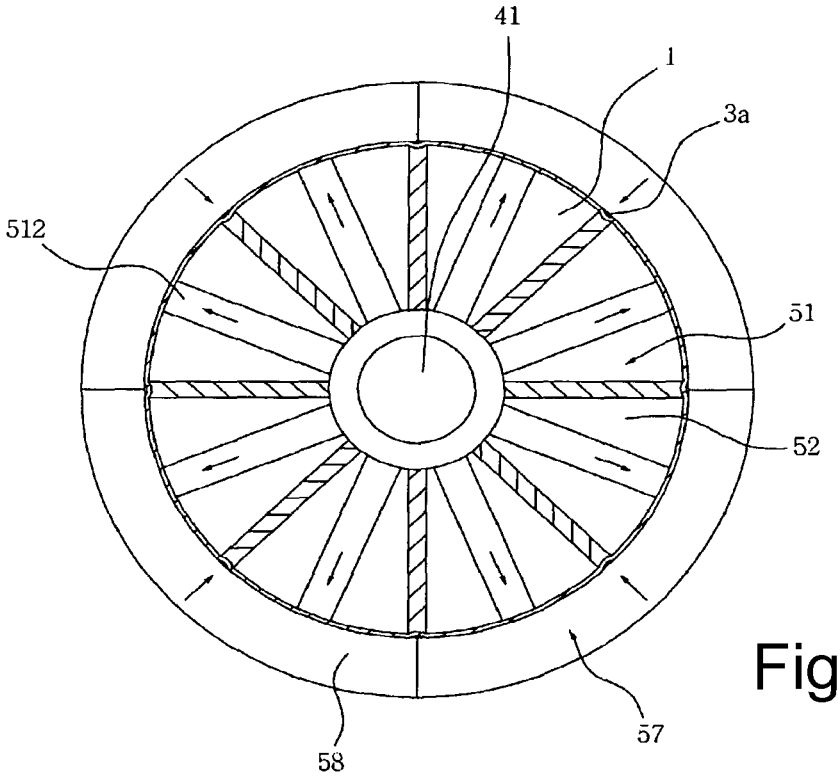
FIG. 4 is a plan view showing a process of processing a sealing lip of a metal can in accordance with the present invention.
Figure 5:
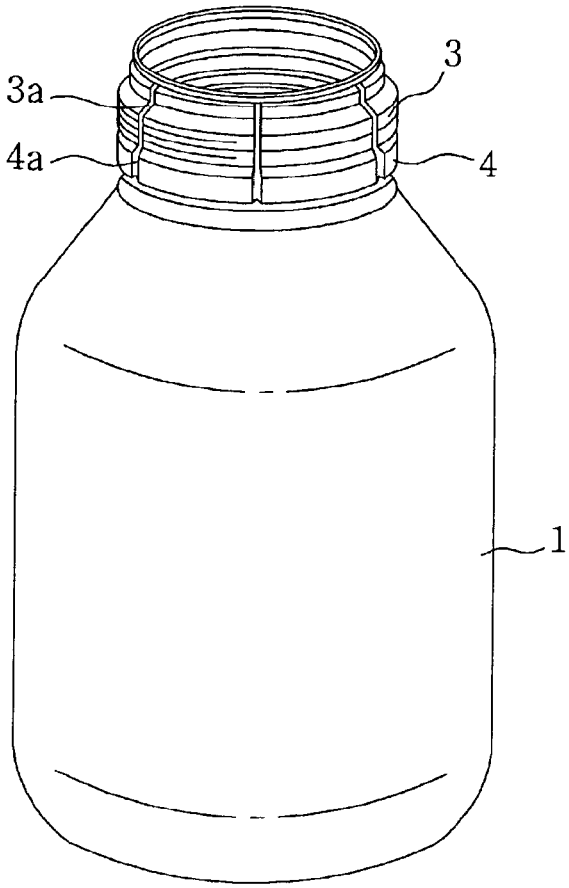
FIG. 5 is a perspective view showing a metal can produced by the apparatus for processing the sealing lip of the metal can in accordance with the present invention.

FIG. 3 is a plan view showing a notch portion and a corresponding notch portion provided in the apparatus for processing the sealing lip of the metal can in accordance with the present invention, FIG. 4 is a plan view showing a process of processing a sealing lip of a metal can in accordance with the present invention, and FIG. 5 is a perspective view showing a metal can produced by the apparatus for processing the sealing lip of the metal can in accordance with the present invention.

Figure 6:
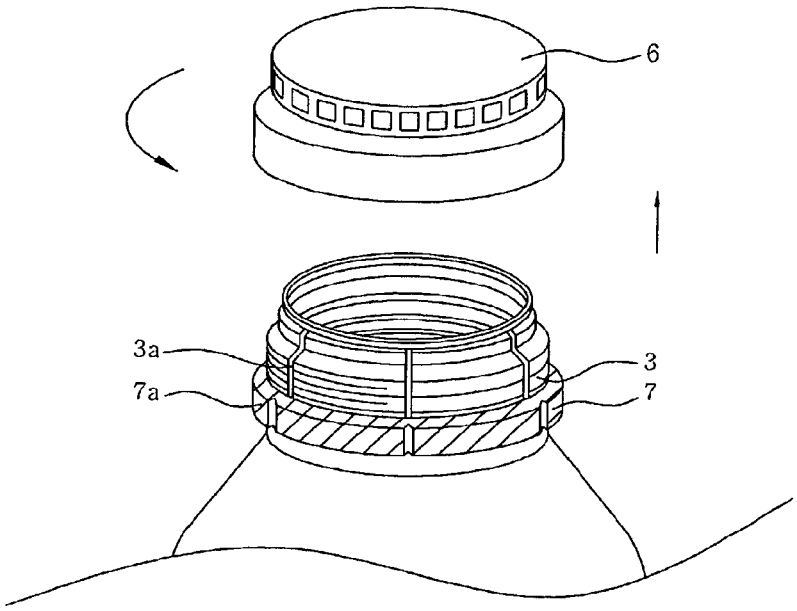
FIG. 6 is a perspective view showing a metal can having a sealing lip with an opened cap.
Figure 7:
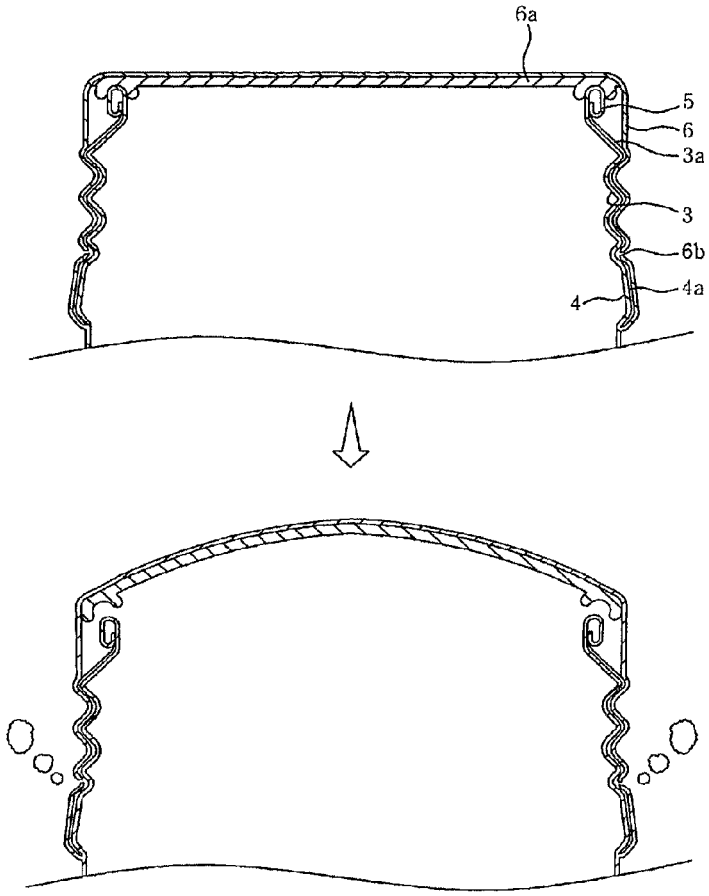
FIG. 7 is a diagram showing a gas discharge state when pressure is created in the metal can in accordance with the present invention.

Moreover, FIG. 6 is a perspective view showing a metal can having a sealing lip with an opened cap, and FIG. 7 is a diagram showing a gas discharge state when pressure is created in the metal can in accordance with the present invention.

As shown in FIG. 3, the beading processing portion 516 formed in the divided bodies 52 of the inner lip processing mold 51 includes a notch portion which is formed at the boundary between the adjacent divided bodies 52, which are opened and closed, and has a predetermined angle in the inward direction.

Moreover, the divided bodies 58 of the second outer lip processing mold 57 includes a corresponding notch portion 581 which is formed at the boundary between the adjacent divided bodies 58 and has a predetermined angle corresponding to the north portion 521 of the inner lip processing mold 51.

When the male beading processing portion 516 of the inner lip processing mold 51 and the female beading processing portion 571 of the second outer lip processing mold 57, which are placed in the corresponding positions, press the metal can 1 from the inside and outside of the metal can 1 to form the beading part 4, the female notch portion 521 and the male notch portion 581 also form notch grooves 4*a* having a predetermined angle in the inward direction at regular intervals on the outer surface of the beading part 4 of the can 1.

Thus, as shown in FIG. 6, in the subsequent process of sealing a cap 6 to the metal can 1, corresponding notch grooves 7*a* corresponding to the notch grooves 4*a* are formed on a ring-shaped member 7 of the cap 6.

As such, when the corresponding notch grooves 7*a* corresponding to the notch grooves 4*a* are formed on the ring-shaped member 7 fixed to the beading part 4 of the metal can 1, the corresponding notch grooves 7*a* of the ring-shaped member 7 are caught by the notch grooves 4*a* of the beading part 4 and are not rotated, which makes it possible to easily open the cap 6 with respect to the ring-shaped member 7.

Moreover, as shown in FIGS. 4 to 6, when the male lip processing portion 515 of the inner lip processing mold 51 and the female lip processing portion 542 of the first outer lip processing mold 54, which are placed in the corresponding positions, press the metal can 1 from the inside and outside of the metal can 1 to form the beading part 4, notch grooves 3*a*, each having a predetermined angle, are formed on the outer surface of the sealing lip 3 of the can in the inward direction at regular intervals by the adjacent boundary of the male lip processing portion 515 formed on the divided bodies 52 of the inner lip processing mold 51. That is, when the inner lip processing mold 51 and the first outer lip processing mold 54 are compressed against each other, the inner lip processing mold 51 is slightly opened to form the notch grooves 3*a* on the can 1.

As such, in the case where the notch grooves 3*a* are formed on the sealing lip 3 of the metal can 1, when pressure is created by gas in the can, the center of the cap 6 is expanded, and thus a curling part 5 of the can 1 and a typical compound 6*a* attached to the inside of the cap 6 are spaced apart from each other such that the gas leaks. Thus, cap 6 and the sealing portion 3 of the can 1 are compressed against each other by the force that the cap 6 is separated, but a small amount of gas is discharged to the outside through the notch groves 6*a* and cut lines 6*b*, thus reducing the internal pressure of the can 1. As a result, the explosion of the can 1 due to the gas can be prevented (see FIG. 7).

Here, the interval between the notch grooves 4*a* formed on the beading part 4 is preferably 0.8 to 1.2 mm, and the interval between the notch grooves 3*a* formed on the sealing lip 3 is preferably 0.02 to 0.1 mm.

If the intervals between the notch grooves 4*a* formed on the beading part 4 is smaller than 0.8 mm or greater than 1.2 mm, the binding force of the ring-shaped member 7 with respect to the beading part 4 is reduced, which is undesirable.

Moreover, if the interval between the notch grooves 3*a* formed on the sealing lip 3 is smaller than 0.02 mm, the gas in the can 1 may not be discharged to the outside, whereas, if it exceeds 0.1 mm, the liquid content in the can 1 may pass therethrough, thus causing corrosion of the cap, which is also undesirable.

Furthermore, ring-shaped elastic members 60 and 61 are provided at the top and bottom of the outer circumferential surface of the inner lip processing mold 51 and at the top of the outer circumferential surface of the first outer lip processing mold 54 such that the divided bodies 52 and 55 provide elastic force in the outward and inward direction. Here, the elastic members 60 and 61 are compression springs.

Next, the operation of the apparatus for processing the sealing lip of the metal can in accordance with the present invention having the above-described configuration will be described with reference to the accompanying drawings below.

Figure 8:
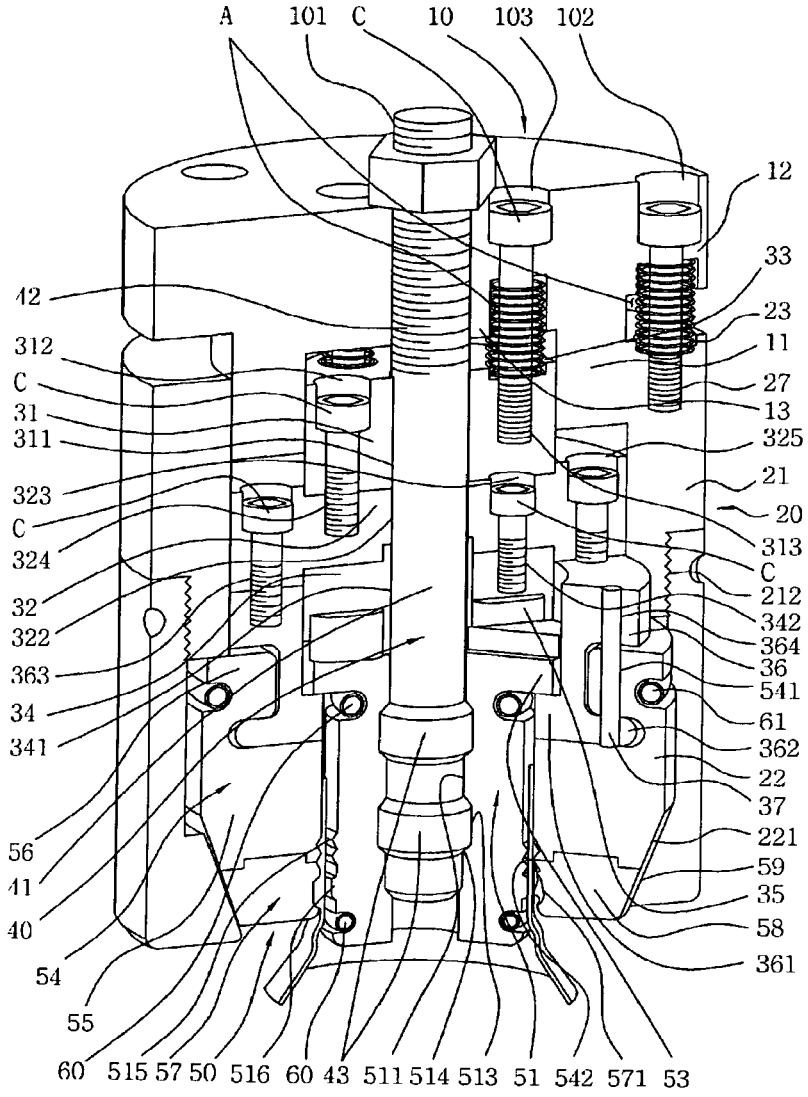
FIGS. 8 to 10 are diagrams showing operating states of the apparatus for processing the sealing lip of the metal can in accordance with the present invention.
Figure 9:
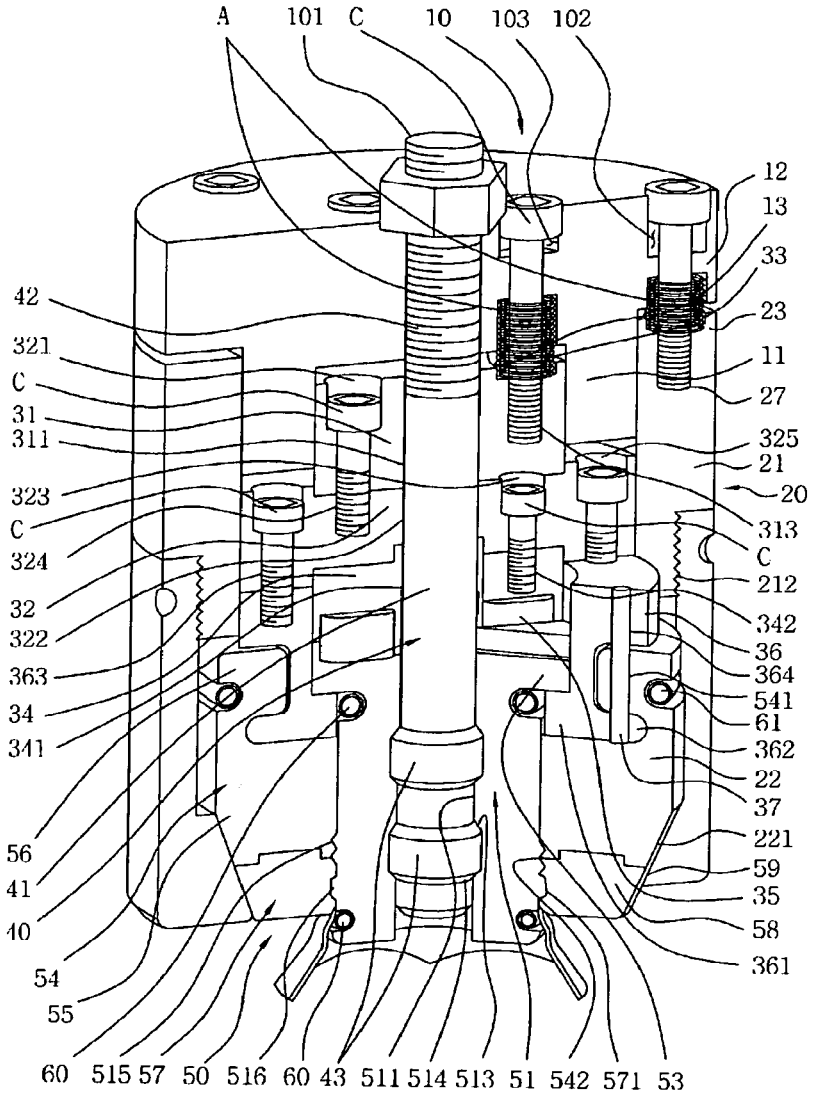
Figure 10:
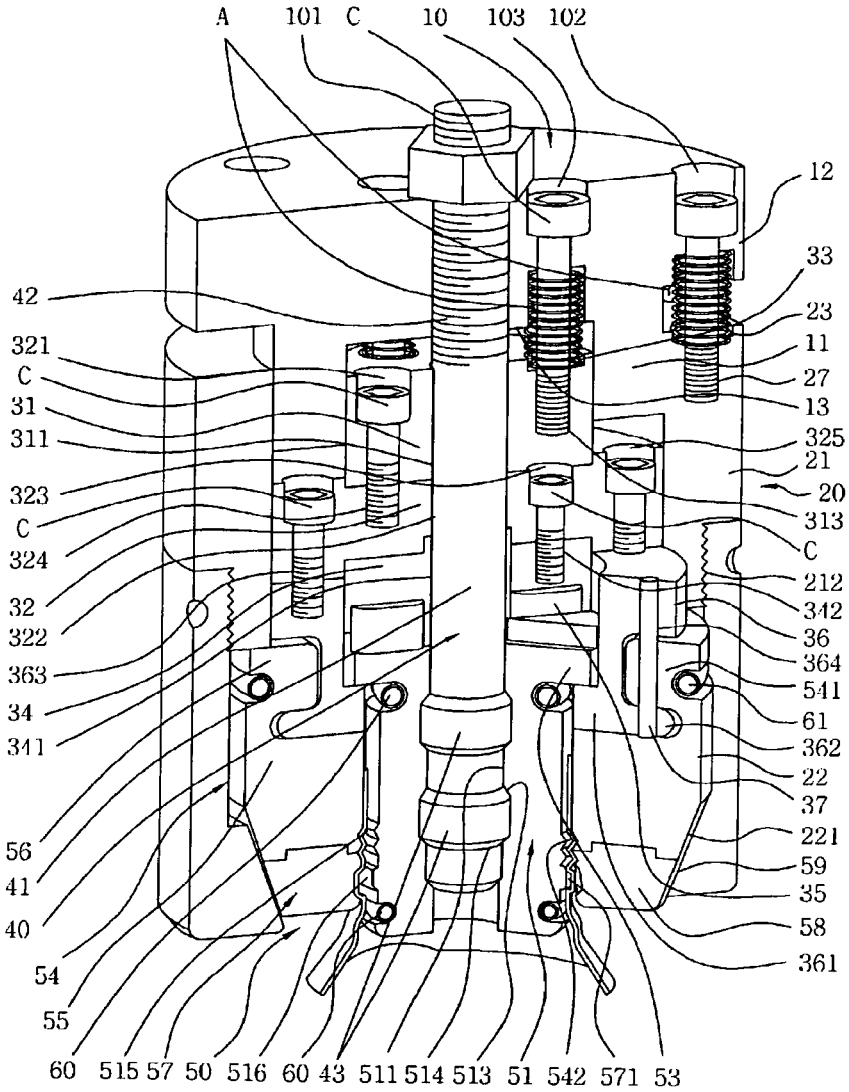
Figure 11:
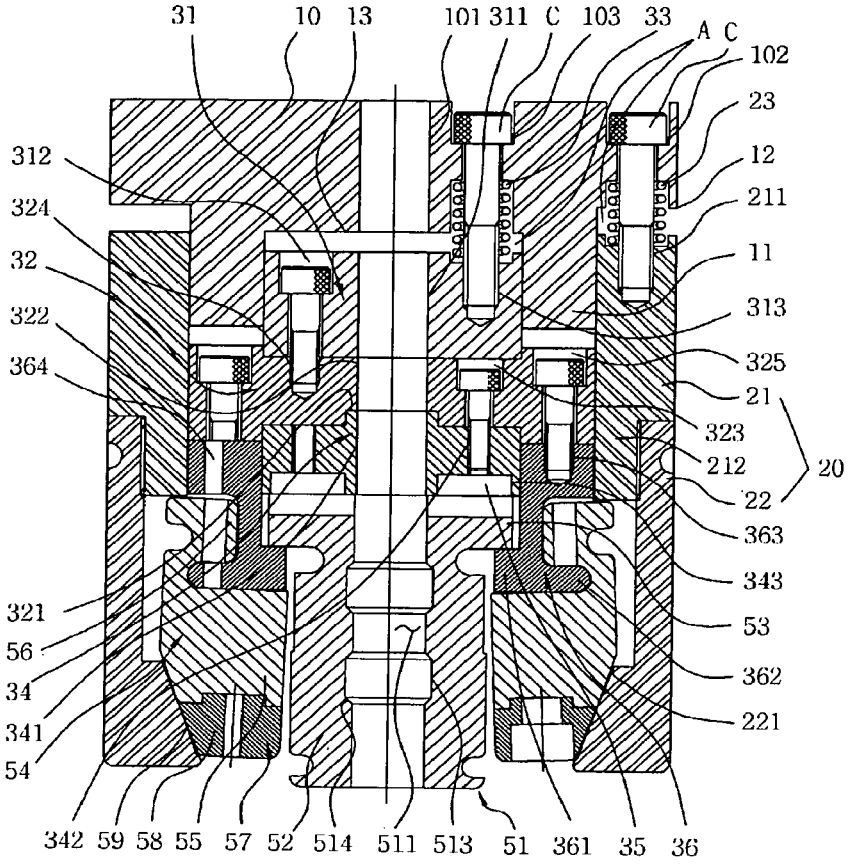
FIGS. 11 and 12 are cross-sectional views showing operating states of the apparatus for processing the sealing lip of the metal can in accordance with the present invention.
Figure 12:
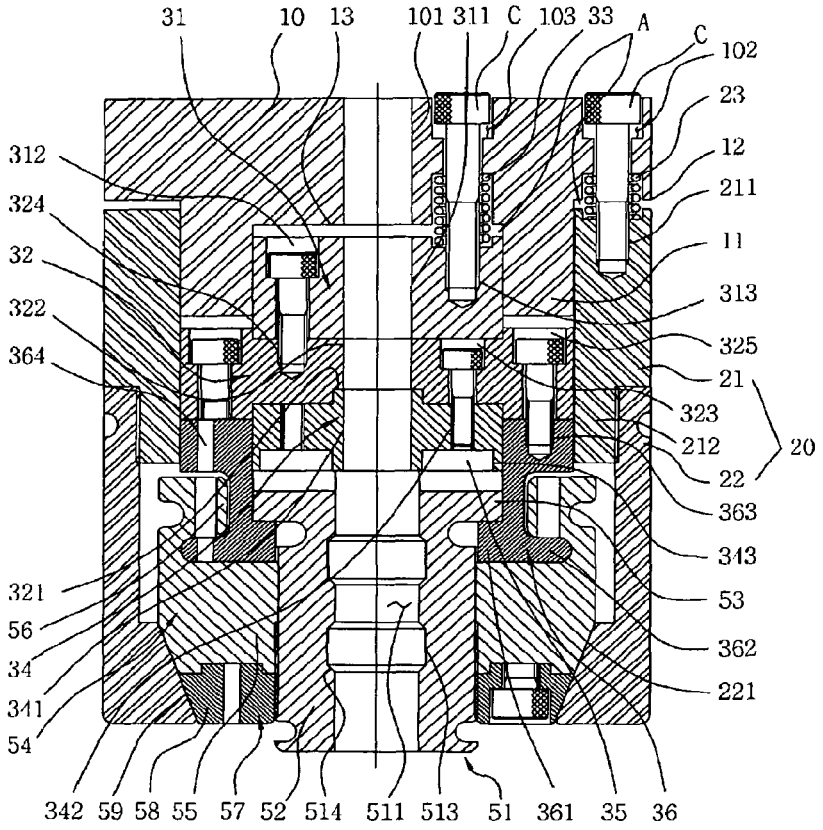

FIGS. 8 to 10 are diagrams showing the operating states of the apparatus for processing the sealing lip of the metal can in accordance with the present invention, and FIGS. 11 and 12 are cross-sectional views showing operating states of the apparatus for processing the sealing lip of the metal can in accordance with the present invention.

First, as shown in FIGS. 8 and 11, when a metal can 1 formed with a bottleneck by a drawing process and a necking process reaches the sealing lip processing process, the apparatus for processing the sealing lip is lowered down by the lowering operation of a lifting means (not shown).

When the apparatus for processing the sealing lip is lowered down to a predetermined position, the bottleneck of the metal can 1 is inserted into an open gap between the inner lip processing mold 51 and the second outer lip processing mold 57 of the lip processing member 50 for the sealing lip processing process.

When the lifting means reaches the lowest point in a state where the bottleneck of the metal can 1 is inserted into the open gap of the lip processing member 50, the pressurization block 10 is slowly lowered down by the elastic force of the elastic member 23 provided between the external fastening portion 12 and the upper receiving body 21 to provide a thrust to the first to third moving bodies 20, 30, and 40 and the lip processing member 50.

When the pressurization block 10 is lowered down to provide the thrust to the first to third moving bodies 20, 30, and 40 and the lip processing member 50, the fastening members C inserted between the external fastening portion 12 of the pressurization block 10 and the upper receiving body 21 and the fastening members C inserted into the internal fastening portion 13 of the pressurization block 10 and the first mold 31 project from the pressurization block 10, and thus the first to third moving bodies 20, 30, and 40 and the lip processing member 50 are lowered down by the elastic force of the elastic members 23 and 33 inserted therebetween.

When the lower end of the first moving body 20, i.e., the lower end of the lower receiving body 22 is not lowered down by the stepped structure located on the base, the elastic member 33 provided between the internal fastening portion 13 of the pressurization block 10 and the first mold 31 provide the thrust to the second and third moving bodies 30 and 40 and the lip processing member 50. That is, when the first moving body 20 is caught by the stepped structure and is not lowered down, the first to fourth molds 31, 32, 34, and 36 as the second moving body 30, the moving shaft 41 as the third moving body 30, and the inner lip processing mold 51 and the first and second outer lip processing mold 54 and 57 as the lip processing member 50 are continuously lowered down.

At this time, in the lip processing member 50 having the divided bodies 52 inserted into the inside of the bottleneck of the metal can 1, the male lip processing portion 515 formed on the inner lip processing mold 51 is located to correspond to the female lip processing portion 542 formed on the first outer lip processing mold 54 being in close contact with the outer surface of the metal can 1, and the male beading processing portion 516 is located to correspond to the female beading processing portion 571 of the second outer lip processing mold 57.

As shown in FIGS. 9 and 12, the first and second outer lip processing molds 54 and 57, which are connected to the second moving body 30, are moved toward the center along the tapered inclined surface 221 formed on the lower receiving body 22 of the first moving body 20 by the lowering of the second moving body 30. Thus, the first and second outer lip processing molds 54 and 57 are in close contact with the outside of the bottleneck of the metal can 1 and are not lowered down by the stepped structure.

At the same time, when the pressurization block 10 is lowered down by the elastic force remaining in the elastic members 23 and 33, the moving shaft 41 as the third moving body 40 moves along the moving inclined surface 514 of the groove 513 formed inside the hollow hole 511 of the inner lip processing mold 51 to push the divided bodies 52 to be opened. Here, the male lip processing portion 515 of the inner lip processing mold 51 and the female lip processing portion 542 of the first outer lip processing mold 54, which are placed in the corresponding positions, press the metal can 1 from the inside and outside of the metal can 1 to form the beading part 4 for the connection with the cap 6.

Along with this, the male beading processing portion 516 of the inner lip processing mold 51 and the female beading processing portion 571 of the second outer lip processing mold 57, which are placed in the corresponding positions, simultaneously form the beading part 4 at the bottom of the sealing lip 3 formed on the metal can 1.

Then, as shown in FIG. 10, the lifting means is lifted up by the reverse operation and, when the inner lip processing mold 51 inserted into the metal can 1 gets out of the metal can 1 during the lifting operation of the apparatus for processing the sealing lip, the elastic restoration force of the elastic members 60 and 61 mounted on the lip processing member 50, i.e., in the inner lip processing mold 51 and the first outer lip processing mold 54 acts such that the divided bodies 52 of the inner lip processing mold 51 move toward the center.

On the contrary, the upper end of the first outer lip processing mold 54 moves toward the center by the elastic member 60, and the inclined portion 59 of the second outer lip processing mold corresponding thereto moves up along the inclined surface 221 of the lower receiving body 22 to be opened in the outward direction such that the supporting state of the bottleneck of the metal can 1 is released.

The preferred embodiments of the invention have been described in detail as above. However, it will be appreciated by those skilled in the art that various changes and modification may be made in these embodiments without departing from the principles and spirit of the invention, the scope of which is defined in the appended claims and their equivalents.

The invention claimed is:

1. An apparatus for processing a sealing lip of a metal can, the apparatus comprising:

a pressurization block which applies pressure downward;

an interlocking means comprising first to third moving bodies elastically lifted up and lowered down by the pressurization block; and a lip processing member which presses the sealing lip of the metal can from the inside and outside of the metal can while moving in the radial direction of the metal can by the lifting and lowering motion of the interlocking means, wherein the first moving body comprises:

an upper receiving body which is put on a projection of the pressurization block and includes fastening grooves, to which the fastening members inserted into the first through holes of the pressurization block are fastened; and a lower receiving body which is connected to the upper receiving body and includes an inclined surface which is tapered toward the center at lower end of an inner surface thereof, wherein the upper receiving body and lower receiving body are connected to each other in a manner that screw threads formed at lower end of the upper receiving body and upper end of the lower receiving body are engaged with each other, wherein the second moving body comprises:

a first mold which is received in the inside of the projection of the pressurization block;

a second mold which is located at the bottom of the first mold and includes stepped grooves formed on upper and lower surfaces;

a third mold which is received in the stepped groove formed on the lower surface of the second mold; and a fourth mold which is located at the bottom of the second mold to surround the outer circumferential surface of the third mold and includes first and second locking projections which project inward and outward from the lower end.

2. The apparatus of claim 1, wherein the pressurization block comprises:

an internal fastening portion which includes a fastening hole formed in the center thereof and second through holes, formed in the circumferential direction of the fastening hole, to which fastening members are fastened;

an external fastening portion which extends in an outward direction from the internal fastening portion and includes first through holes, to which the fastening members are fastened; and a projection which is located at a lower surface between the internal fastening portion and the external fastening portion.

3. The apparatus of claim 1, wherein the first mold comprises a hollow hole in the center thereof, fastening through holes which are formed in the circumferential direction of the hollow hole and fastened to the second mold through the fastening members, and fastening grooves which coincide with the second through holes of the pressurization block.

4. The apparatus of claim 1, wherein the second mold comprises a hollow hole in the center thereof, first fastening through holes which are formed in the circumferential direction of the hollow hole and fastened to the third mold through the fastening members, second fastening grooves which are formed in the circumferential direction of the hollow hole and fastened to the fourth mold through the fastening members, and fastening grooves to which the fastening members of the first mold are fastened.

5. The apparatus of claim 1, wherein the third mold comprises a hollow hole in the center thereof, fastening grooves, formed in the circumferential direction of the fastening hole, to which the fastening members, inserted into the first fastening through holes of the second mold, are fastened, and connecting piece fixing grooves, which are formed in the circumferential direction of the lower surface thereof, to which connecting pieces are inserted and fixed.

6. The apparatus of claim 2, wherein a chamber which shares a predetermined region is provided on the boundary of a fastening region between the pressurization block and the interlocking means corresponding to the internal and external fastening portions of the pressurization block, and an elastic member is mounted on the chamber.

7. The apparatus of claim 2, wherein the first and second through holes are slide guide holes through which the fastening members freely move.

8. The apparatus of claim 1, wherein the fourth mold comprises fastening grooves, to which the fastening members, inserted into the second fastening through holes of the second mold, are fastened, and pin fixing holes which are arranged at regular intervals between adjacent fastening grooves.

9. The apparatus of claim 8, wherein the third moving body comprises a connecting portion which is connected to the pressurization block and a bar-shaped moving shaft which penetrates the pressurization block and the interlocking means, is disposed vertically, and includes a projection projecting outward from the lower end.

10. The apparatus of claim 9, wherein the lip processing member comprises an inner lip processing mold which includes a plurality of divided bodies which surround the moving shaft, each of the divided bodies including a locking portion on the upper end, which is locked by a first locking projection of the fourth mold, and a male lip processing portion and a male beading processing portion, which are formed on an outer circumferential surface of the inner lip processing mold.

11. The apparatus of claim 10, wherein the inner lip processing mold further comprises a groove which includes a moving inclined surface being in close contact with a projection of the moving shaft.

12. The apparatus of claim 11, wherein the lip processing member comprises first and second outer lip processing molds, which each includes a locking portion on the upper end, which is locked by the first locking projection of the fourth mold, a female lip processing portion and a female beading processing portion, which are formed on an inner circumferential surface of the first and second outer lip processing molds and correspond to the male lip processing portion and the male beading processing portion of the inner lip processing mold, and an inclined portion which is placed on the inclined surface of the lower receiving body and formed on a lower end of an outer circumferential surface of the first and second outer lip processing molds.

13. The apparatus of claim 12, wherein the locking portion comprises pin guide holes which coincide with the pin fixing holes of the fourth mold and each has a diameter greater than that of the pin fixing hole.

14. The apparatus of claim 12, wherein the first and second outer lip processing molds are divided from each other and connected by the fastening members.

15. The apparatus of claim 14, wherein the divided bodies of the inner lip processing mold comprise a notch portion such that notch grooves are formed on an outer surface of a beading part of the metal can in an inward direction of a boundary of the beading processing portion of the inner lip processing mold, and the divided bodies of the second outer lip processing mold comprise a corresponding notch portion corresponding to the notch portion in the outward direction of a boundary of the beading processing portion of the second outer lip processing mold.

16. The apparatus of claim 12, wherein a ring-shaped elastic member is provided on the outer circumferential surface of the inner lip processing mold and the outer circumferential surface of the first outer lip processing mold.

17. The apparatus of claim 16, wherein the elastic member is an extension spring.

* * * * *